US008608275B2

(12) United States Patent
Owaki et al.

(10) Patent No.: US 8,608,275 B2
(45) Date of Patent: Dec. 17, 2013

(54) LIQUID EJECTING HEAD

(75) Inventors: Hiroshige Owaki, Okaya (JP); Haruhisa Uezawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 80 days.

(21) Appl. No.: 13/246,708

(22) Filed: Sep. 27, 2011

(65) Prior Publication Data

US 2012/0075387 A1 Mar. 29, 2012

(30) Foreign Application Priority Data

Sep. 28, 2010 (JP) ..... 2010-216566

(51) Int. Cl.
*B41J 29/38* (2006.01)
*B41J 2/04* (2006.01)
*B41J 2/05* (2006.01)

(52) U.S. Cl.
USPC ..... 347/17; 347/54; 347/65

(58) Field of Classification Search
None
See application file for complete search history.

(56) References Cited

U.S. PATENT DOCUMENTS

| | | | | |
|---|---|---|---|---|
| 5,424,767 | A * | 6/1995 | Alavizadeh et al. | 347/17 |
| 5,958,269 | A * | 9/1999 | Suzuki et al. | 219/216 |
| 6,193,365 | B1 * | 2/2001 | Ikezaki | 347/88 |
| 7,207,641 | B2 * | 4/2007 | Komatsu et al. | 347/17 |
| 2005/0052485 | A1 | 3/2005 | Komatsu et al. | |

FOREIGN PATENT DOCUMENTS

| | | |
|---|---|---|
| JP | 2005081597 | 3/2005 |

* cited by examiner

*Primary Examiner* — Geoffrey Mruk
(74) *Attorney, Agent, or Firm* — Workman Nydegger

(57) ABSTRACT

A liquid ejecting head includes a flow path unit that has a nozzle line formed by a plurality of nozzles and includes a flow path communicating with the nozzles, a head case that forms a shared liquid flow path for supplying a liquid to the flow path of the flow path unit and is connected with the flow path unit, and a sheet-like heater that is mounted on a side surface of the head case and has a continuous heat-generatable heating element folded multiple times. A portion of the heating element located in a region close to a position opposing the shared liquid flow path is narrower than a portion of the heating element located at a position other than the region.

13 Claims, 5 Drawing Sheets

LIQUID EJECTING HEAD

The entire disclosure of Japanese Patent Application No: 2010-216566, filed Sep. 28, 2010 is expressly incorporated by reference herein.

BACKGROUND

1. Technical Field

The present invention relates to a liquid ejecting head for an ink jet type recording head or the like which applies a pressure change to a pressure generating chamber, communicating with nozzles, to eject from the nozzles a liquid in the pressure generating chamber.

2. Related Art

Examples of liquid ejecting heads which generate a pressure change in a liquid in a pressure generating chamber to eject the liquid as liquid droplets from nozzles include an ink jet type recording head (hereinafter simply referred to as "recording head") used in an image recording apparatus such as an ink jet type recording apparatus (hereinafter simply referred to as "printer"), a color material ejecting head used to manufacture a color filter for a liquid crystal display or the like, an electrode material ejecting head used to form an electrode of an organic EL (Electro Luminescence) display, an FED (Field Emission Display) or the like, and a bioorganic material ejecting head used to manufacture a biochip (biochemical element).

For example, some of the recording heads are configured by mounting a flow path unit in which a series of liquid flow paths extending from a reservoir to a nozzle via a pressure generating chamber are formed, an actuator unit having a pressure generating element capable of varying the volume of the pressure generating chamber, and the like to a head case made of a resin. The flow path unit is connected with a nozzle plate having a plurality of nozzles provided therein.

A liquid to be ejected from such a recording head has a viscosity suitable for ejection, e.g., approximately 4 mPa·s, at normal temperature. The viscosity of a liquid correlates with the temperature such that the lower the temperature, the higher the viscosity, and the higher the temperature, the lower the viscosity. There is a case where a recording head is used to eject a liquid in a so-called high-viscosity region of 8 mPa·s or greater at normal temperature, such as an ultraviolet curable ink. Accordingly, there is a recording head provided with a heater to heat a liquid so that the viscosity of the liquid to be ejected from each nozzle becomes a uniform value suitable for ejection of the liquid regardless of the environmental temperature. A known example of such a heater is a thin sheet-like heater having a heating element folded back multiple times in a wavy wire. In addition, there has been proposed a heater which varies the amount of heat generated by making the layout pitch of portions of the heating element located in the center portion of the recording head wider than the layout pitch of portions of the heating element located at both ends of the recording head in order to uniformly heat the ink in the recording head (for example, refer to JP-A-2005-081597).

SUMMARY

Since the above heater uniformly heats regions other than the flow path of the recording head, the heater generates more heat than necessary, resulting in inefficient heating. In particular, when the recording head is comparatively large, regions other than the flow path of the recording head become wider, so that the amount of heat generated by the heater becomes larger, eventually increasing the power consumption of the heater. When the heater is disposed on a side surface of the recording head only in a region opposing the flow path, heat of the recording head is discharged from a region which does not face the flow path, resulting in a poor heat retaining property. When a plurality of heaters are mounted in association with a plurality of flow paths, it becomes difficult to manufacture the liquid ejecting head.

An advantage of some aspects of the invention is that it provides a liquid ejecting head efficiently which heats a flow path therein.

According to an aspect of the invention, there is provided a liquid ejecting head including: a flow path unit that has a nozzle line formed by a plurality of nozzles and includes a flow path communicating with the nozzles; a head case that forms a shared liquid flow path for supplying a liquid to the flow path of the flow path unit and is connected with the flow path unit; and a sheet-like heater that is mounted on a side surface of the head case and has a continuous heat-generatable heating element folded multiple times, a portion of the heating element located in a region close to a position opposing the shared liquid flow path being narrower than a portion of the heating element located at a position other than the region.

This configuration can increase the amount of heat generated by the heating element at a position opposing the shared liquid flow path, and positively heat the shared liquid flow path which is a flow path for ink in the liquid ejecting head. This allows the ink to be efficiently heated, suppressing power consumption of the heater. The arrangement of the heating element at a position which does not face the shared liquid flow path prevents the ink in the flow path from discharging heat outside the liquid ejecting head, thus improving the heat retaining property. Further, since a region where the heating element is not disposed can be reduced, the rigidity of the heater can be increased, improving the assembly of the heater when mounted to the liquid ejecting head. In addition, even in case of a liquid ejecting head that has a plurality of shared liquid flow paths, it is not necessary to provide a plurality of heaters in association with the shared liquid flow paths, making it easier to manufacture the liquid ejecting head.

In the foregoing configuration, it is desirable that portions of the heating element located at both ends of the heater in the nozzle line direction be narrower than a portion of the heating element located in the center of the heater in the nozzle line direction.

This configuration can increase the amount of heat generated by the heating element at both ends of the heater in the nozzle line direction, so that both end portions of the liquid ejecting head which are likely to discharge heat can be positively heated. This can suppress non-uniformness of the temperature of the ink in the liquid ejecting head.

It is also desirable to take a structure where intervals between adjoining folded portions of the heating element are set to a uniform interval.

It is desirable that a portion of the heating element located at an end of the heater on the flow path unit side be narrower than a portion of the heating element located at an end of the heater opposite to the flow path unit in a direction orthogonal to the nozzle line in a plane of the heater.

This configuration can increase the amount of heat generated by the heating element at the end of the heater on the flow path unit side, so that the ink on the flow path unit side which is likely to discharge heat can be positively heated. This can permit the ink to be heated efficiently.

Further, it is desirable that the thickness of the heating element vary in a film thickness direction.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
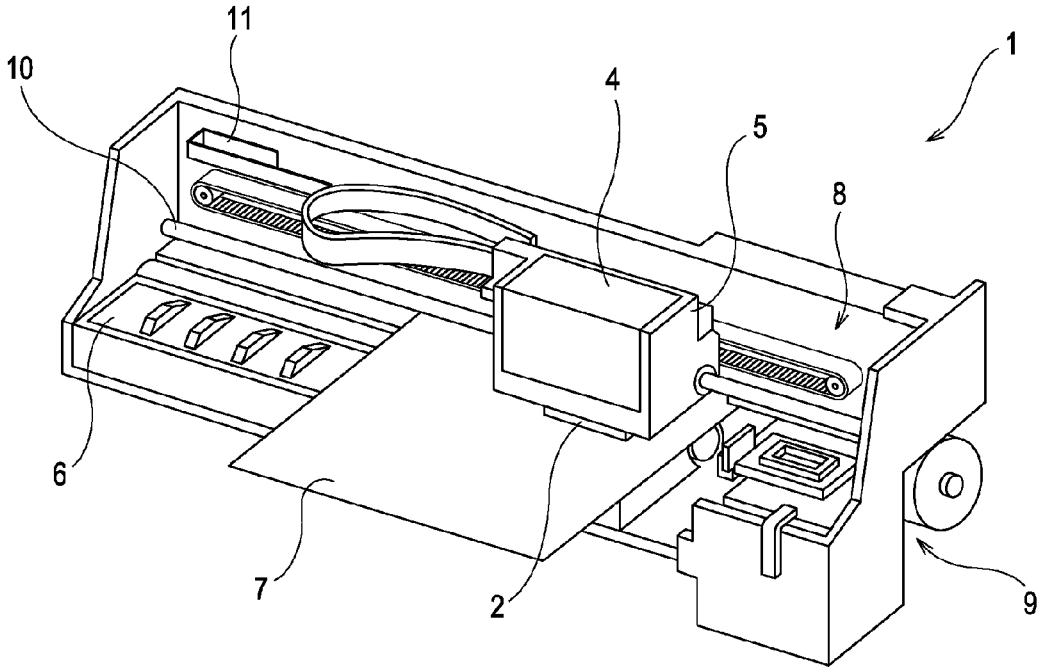
FIG. 1 is a perspective view of a printer.

The best mode of carrying out the invention will be described below with reference to the accompanying drawings. Although the preferred embodiments of the invention are described by way of example in the following descriptions of the exemplary embodiments, the scope of the invention is not limited to those embodiments unless it is specifically described hereinunder that the invention is limited. Hereinafter, a case where an ink jet type recording apparatus 1 (hereinafter simply called "printer") shown in FIG. 1 will be illustrated as a liquid ejecting apparatus.

The printer 1 has a schematic configuration such that an ink jet type recording head 2 (hereinafter simply called "recording head"), one kind of a liquid ejecting head, is mounted on the printer 1 that includes a carriage 5 on which the recording head 2 and ink cartridges 4 are mounted, a platen 6 disposed under the recording head 2, a carriage moving mechanism 8 which moves the carriage 5 mounted with the recording head 2 in a sheet width direction of a recording sheet 7 (one kind of an object where a liquid ejected from a nozzle lands), and a sheet transporting mechanism 9 which transports the recording sheet 7 in a sheet transporting direction orthogonal to the sheet width direction. The sheet width direction herein corresponds to a main scanning direction (reciprocation direction of the recording head 2), and the sheet transporting direction corresponds to a sub-scanning direction (direction orthogonal to the scanning direction of the recording head 2).

The carriage 5 is pivotally supported by a guide rod 10 suspended across in the main scanning direction, and is configured to move along the guide rod 10 in the main scanning direction by the actuation of the carriage moving mechanism 8. The position of the carriage 5 in the main scanning direction is detected by a linear encoder 11, which sends a detection signal as positional information to a controller (not shown). As a result, the controller can control the recording operation (ejection operation) or the like with the recording head 2 while identifying the scanning position of the carriage 5 (recording head 2).

The recording head 2 is mounted on the bottom (on the recording sheet 7 side in the recording operation) of the carriage 5. Each ink cartridge 4 storing an ink (one kind of a liquid) is detachably mounted on the carriage 5. The recording head 2 has a liquid flow path inside, which communicates with the interior of the ink cartridge 4 to supply the ink in the ink cartridge 4 to the recording head 2.

Figure 2:
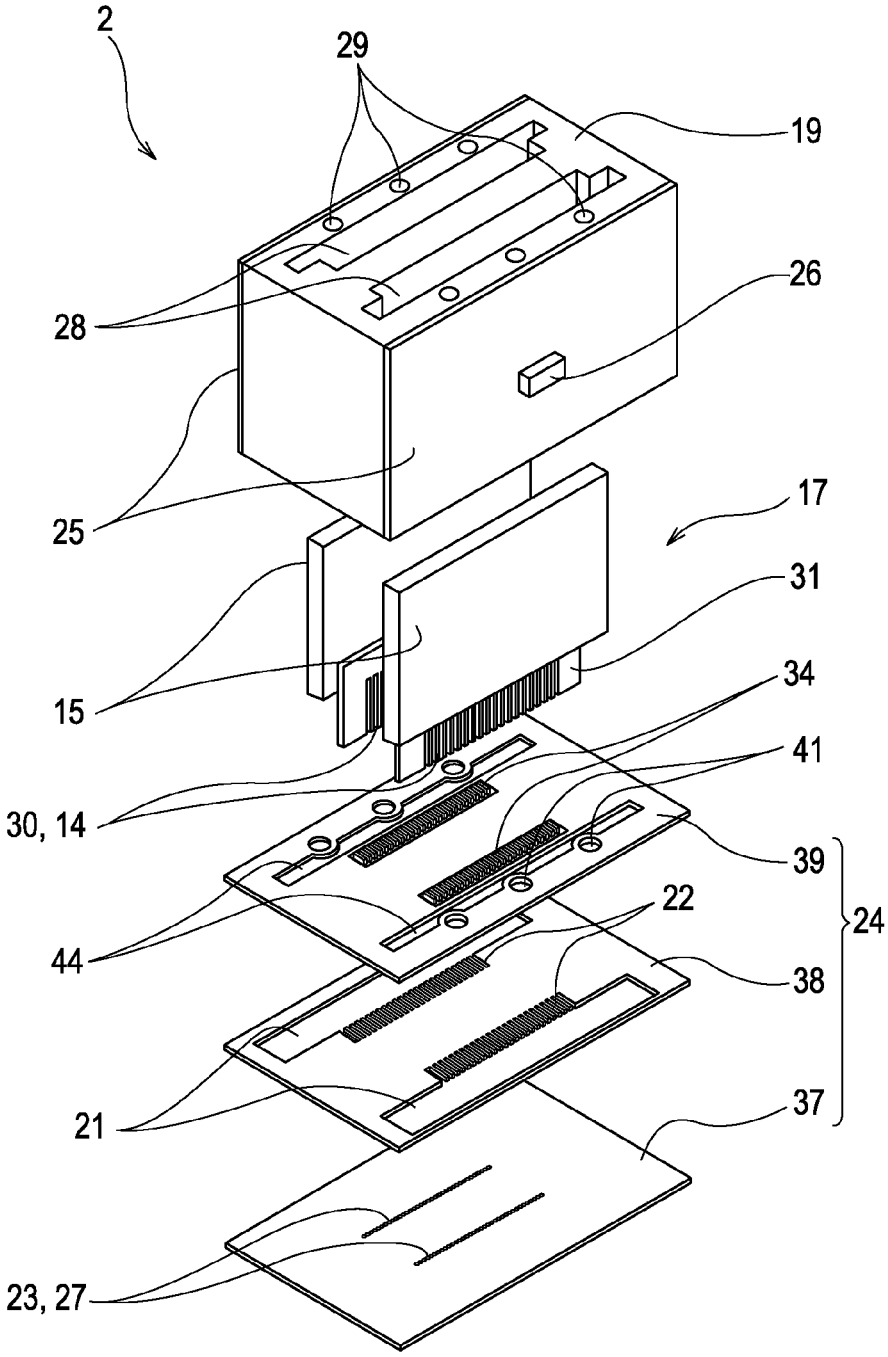
FIG. 2 is an exploded perspective view of a liquid ejecting head.
Figure 3:
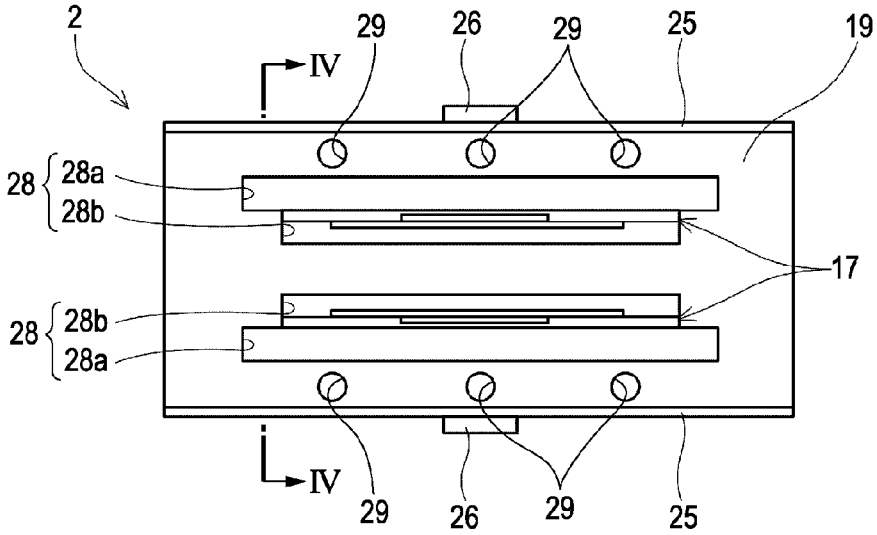
FIG. 3 is a plan view of the liquid ejecting head.
Figure 4:
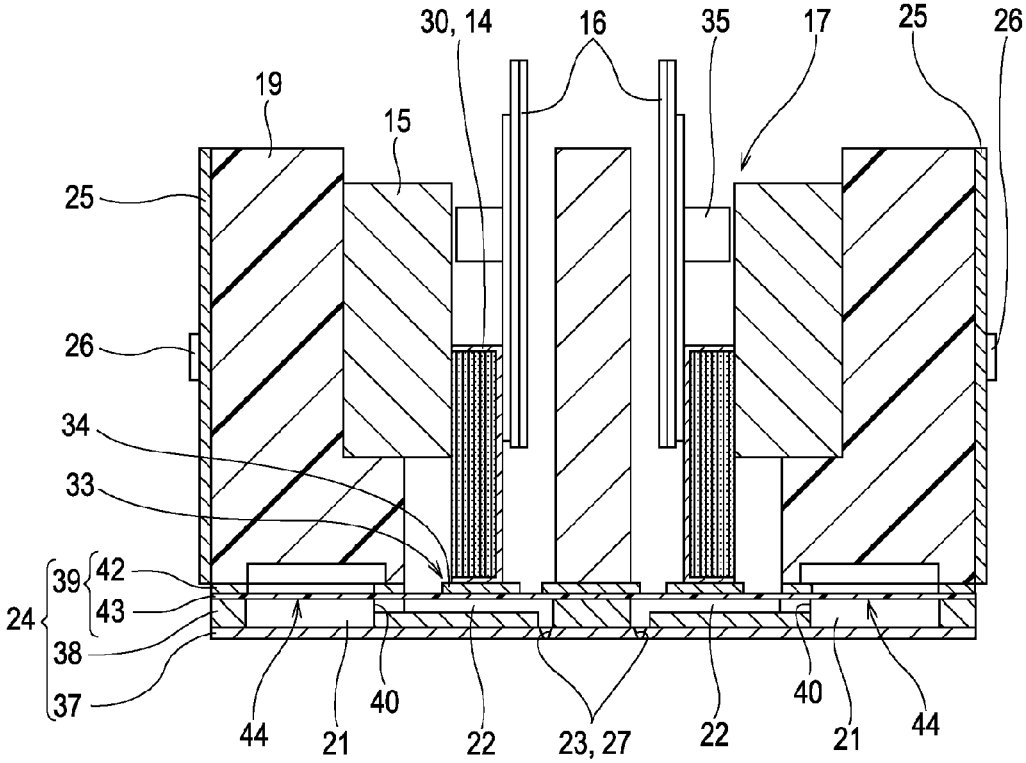
FIG. 4 is a cross-sectional view along line IV-IV in FIG. 3.

Next, the configuration of the recording head 2 will be elaborated. FIG. 2 is an exploded perspective view of the recording head 2, FIG. 3 is a plan view of the recording head 2, and FIG. 4 is a cross-sectional view along line IV-IV in FIG. 3. The recording head 2 according to the embodiment is configured to include two vibrator units 17 each of which is unitized by a piezoelectric vibrator group 14, a fixing plate 15, a flexible cable 16, etc. The recording head 2 further includes a head case 19 where the vibrator units 17 can be accommodated, a flow path unit 24 which forms a series of ink flow paths extending from reservoirs (shared ink chambers) 21 to nozzles 23 through pressure generating chambers 22, heaters 25 mounted on side surfaces of the head case 19, and thermistors 26 (one kind of a temperature sensor) each mounted on a side surface of the heater 25.

The head case 19 is a hollow box-like member made of a resin, such as epoxy resin, and has a distal end face (bottom surface) connected with the flow path unit 24. According to the embodiment, two retaining cavities 28 are formed inside the head case 19 to retain the vibrator units 17 which are one kind of actuator. Each retaining cavity 28 includes a fixing-plate retaining cavity 28*a* to retain the fixing plate 15, and a piezoelectric-vibrator retaining cavity 28*b* to retain the piezoelectric vibrator group 14, and the retaining cavities 28 oppose each other with the piezoelectric-vibrator retaining cavities 28*b* facing each other (see FIG. 3). Three shared liquid flow paths 29 are formed in a row on both sides of the head case 19 with the two retaining cavities 28 sandwiched between the rows of shared liquid flow paths 29 (i.e., there are a total of six shared liquid flow paths 29). According to the embodiment, the three shared liquid flow paths 29 on one side of the head case 19 are formed at both side ends and the center of the recording head 2 in the nozzle line direction. The shared liquid flow paths 29 supply inks from the ink cartridges 4 to the reservoirs 21, and are formed so as to penetrate through the head case 19 in the height direction thereof. The heaters 25 and thermistors 26 to be described later are provided on the side surfaces of the head case 19 which face the shared liquid flow paths 29.

Next, the vibrator unit 17 will be described. Piezoelectric vibrators 30 (one kind of a pressure generating element) forming the piezoelectric vibrator group 14 are formed in the shape of longitudinally elongated comb teeth by cutting a piezoelectric vibrating plate 31 or a base into very thin slits of several tens of micrometers or so. The piezoelectric vibrators 30 are configured as a vertical vibration type piezoelectric vibrators stretchable in the vertical direction. Each piezoelectric vibrator 30 is fixed like a so-called cantilever with a fixed end connected to the fixing plate 15 and a free end protruding outward of the distal edge of the fixing plate 15. The tip of the free end of each piezoelectric vibrator 30 is connected to an island 34 constituting a diaphragm 33 in the flow path unit 24. The flexible cable 16 is electrically connected to the piezoelectric vibrators 30 at a side surface of the fixed end which is opposite to the fixing plate 15. A control IC 35 which controls driving or the like of the individual piezoelectric vibrators 30 is mounted on a surface of the flexible cable 16. The fixing plate 15 supporting the individual piezoelectric vibrators 30 is formed of a metal plate having rigidity to receive the reaction force from the piezoelectric vibrators 30, and is formed of a stainless steel plate with a thickness of about 1 mm.

Next, the flow path unit 24 will be described. The flow path unit 24 includes a nozzle plate 37, a flow path forming substrate 38 and a vibration plate 39, and is connected to the head case 19 on the side opposite to that of the nozzle plate 37. The flow path unit 24 is formed by stacking the nozzle plate 37 on one surface of the flow path forming substrate 38 and the vibration plate 39 on the other surface of the flow path forming substrate 38 and integrating them using an adhesive or the like.

The nozzle plate 37 is a thin plate of stainless steel in which a plurality of nozzles 23 are provided in lines at pitches corresponding to the dot forming density. According to the embodiment, for example, 180 nozzles 23 are formed in a line to form a nozzle line 27. According to the embodiment, two nozzle lines 27 are provided side by side.

The flow path forming substrate 38 is a plate member forming a series of ink flow paths including the reservoirs 21, ink supply ports 40, and the pressure generating chambers 22. Specifically, the flow path forming substrate 38 is a plate member in which two lines of cavities to be a plurality of pressure generating chambers 22 respectively communicating with the nozzles 23, the cavities being defined by partitions, are formed, and two lines of cavities to be a plurality of ink supply ports 40 respectively corresponding to the pressure generating chambers 22 and the reservoirs 21 are formed. The flow path forming substrate 38 according to the embodiment is prepared by etching a silicon wafer. The pressure generating chambers 22 are formed as elongated chambers in a direction orthogonal to the direction in which the line of nozzles 23 (nozzle line direction) extends, and the ink supply ports 40 are formed as narrow portions with a narrow flow path width, connecting the pressure generating chambers 22 and the reservoirs 21. The reservoir 21 communicates with the ink cartridges 4 at an upper portion via ink inlets 41 of the vibration plate 39 to be described later and the shared liquid flow path 29 of the head case 19, and communicates with the corresponding pressure generating chambers 22 via the ink supply ports 40. Accordingly, the reservoir 21 can supply the inks stored in the ink cartridges 4 to the individual pressure generating chambers 22. That is, the ink inlets 41, the reservoir 21, the ink supply ports 40 and the pressure generating chambers 22 form a series of flow paths (corresponding to flow paths in the invention) communicating with the nozzles 23.

The vibration plate 39 is a composite plate member with a double structure formed by laminating a metal support plate 42 of stainless steel or the like with a resin film 43 of PPS (PolyPhenylene Sulfide) or the like. The ink inlets 41 communicating with the shared liquid flow paths 29 penetrate the vibration plate 39 in the vertical direction. According to the embodiment, six ink inlets 41 are formed in association with six shared liquid flow paths 29, three ink inlets 41 communicating with one reservoir 21. The vibration plate 39 has the diaphragms 33 each of which blocks one opening side of the pressure generating chambers 22 to change the volumes thereof, and two compliance sections 44 each of which blocks one opening side of the reservoir 21. The diaphragm 33 is formed by etching that portion of the support plate 42 which corresponds to the pressure generating chambers 22 to remove this portion in an annular shape, forming a plurality of islands 34 for connection with the tips of the free ends of the piezoelectric vibrators 30. The island 34 has a block shape elongated in the direction orthogonal to the direction in which the line of nozzles 23 extends like the planar shape of the pressure generating chamber 22, and the resin film 43 around the island 34 serves as an elastic film. The portion which serves as the compliance section 44, namely, the portion which corresponds to the reservoir 21 is only the resin film 43 left by etching the support plate 42 according to the shape of the opening of the reservoir 21.

Since the distal end face of the piezoelectric vibrator 30 is connected to the island 34, the volume of the pressure generating chamber 22 can be changed by stretching the free end of the piezoelectric vibrator 30. The change in volume causes a pressure change on the ink in the pressure generating chamber 22. Then, the recording head 2 ejects (discharges) ink droplets from the nozzles 23 using the pressure change.

Figure 5:
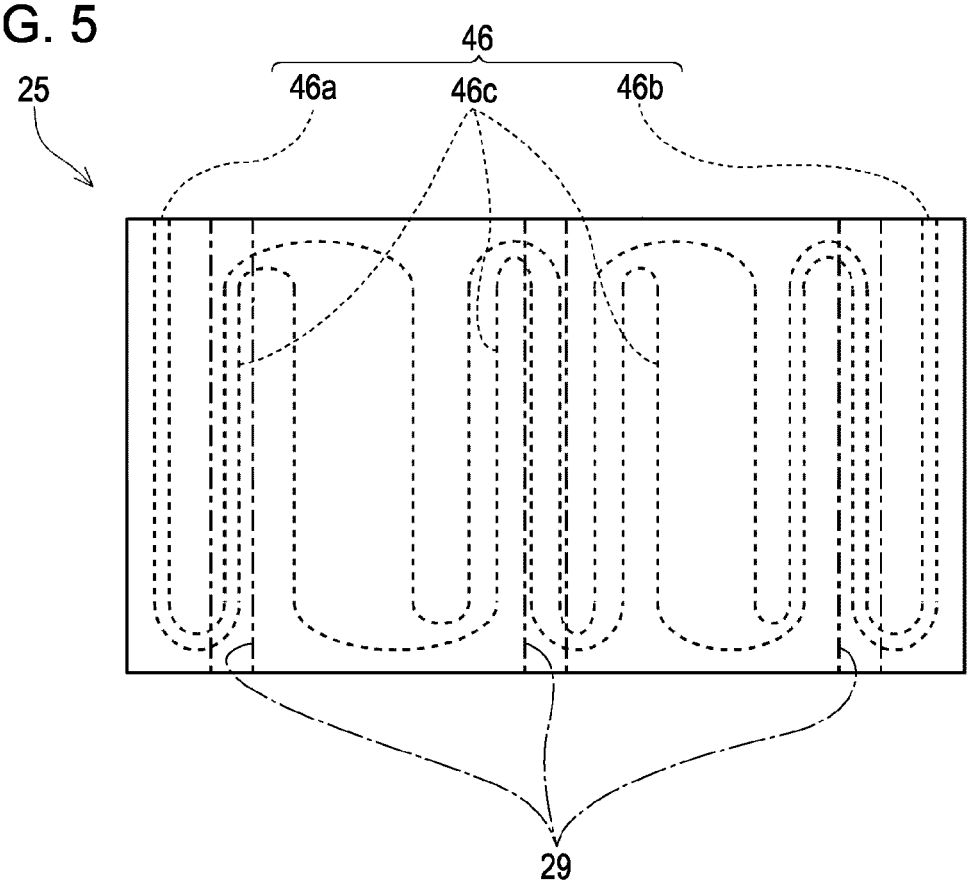
FIG. 5 is a side view of a heater according to a first embodiment.

Next, the heater 25 will be described referring to FIG. 5. The heater 25 according to the embodiment is a sheet-like (film-like) heater having a continuous heat-generatable heating element 46 (of a nickel alloy, stainless steel or the like) sandwiched by a polyimide resin or the like. The heaters 25 are mounted by an adhesive or the like (silicone grease or the like) with high heat conductivity (e.g., $100(W \cdot m^{-1} \cdot K^{-1})$ or higher) in such a way as to cover the entire surfaces of the sides of the head case 19 where lines of the shared liquid flow paths 29 are provided (upper side surface in FIG. 3 and lower side surface in FIG. 3 according to the embodiment). The heating element 46 is disposed so as to meander (folded multiple times) in the plane of the heater 25, and its thickness varies in the nozzle line direction (horizontal direction in FIG. 3 or FIG. 5). The heating element 46 disposed in a region close to a position opposing the shared liquid flow path 29 is made narrower than the heating element 46 disposed at a position other than that region. In FIG. 5, the positions of the shared liquid flow paths 29 with the heaters 25 mounted on the recording head 2 are shown by alternate long and short dash lines.

In detail, as shown in FIG. 5, the heating element 46 has an anode side end portion **46*a* on one side end portion, and a cathode side end portion 46*b* on the other side end portion at the top side of the heater 25 (side on the ink cartridge 4 side), extends in a direction perpendicular to the top side (vertical direction in FIG. 5) from the anode side end portion 46*a* or the cathode side end portion 46*b*, is folded back toward the top side of the heater 25 in a U shape at the end portion of the bottom side, extends vertically again, and is folded back toward the bottom side of the heater 25 in a U shape at the end portion of the top side. Repeating such extension and folding multiple times, the heating element 46 is arranged so as to meander in a wave shape. Therefore, individual straight portions 46*c* of the heating element 46 extending vertically are arranged side by side in the nozzle line direction. The heating element 46 according to the embodiment has ten straight portions 46*c* (see FIG. 5). The straight portions 46*c* of the heating element 46 disposed at both side end portions and a center portion in the heater plane are made narrower than the straight portions 46*c* of the heating element 46 disposed in the remaining region (region other than both side end portions and the center portion) in association with the shared liquid flow paths 29 formed at both side end portions and the center portion of the recording head 2. In addition, the straight portions 46*c* disposed at both side end portions in the heater plane are made narrower than the straight portions 46*c* disposed at the center portion in the heater plane. According to the embodiment, ten straight portions 46*c* are arranged side by side, and three straight portions 46*c* disposed at the center portion in the nozzle line direction are formed wider than five straight portions 46*c* disposed at both side end portions (two at the left side end portion and three at the right side end portion in FIG. 5). Further, the straight portions 46*c* respectively disposed between the center portion and both side end portions are formed widest, one straight portion 46*c* being disposed between the center portion and the left side end portion and between the center portion and the right side end portion (e.g., the three straight portions 46*c* disposed at the center portion in the nozzle line direction have a line width of 0.5 mm, the five straight portions 46***c* disposed at both side end portions have a line width of 0.3 mm, and the remaining straight portions 46*c* have a line width of 2 mm). The straight portions 46*c* are disposed to planarly overlap portions facing the shared liquid flow paths 29 so that heat generated by the heating element 46 is efficiently transferred to the shared liquid flow paths 29. The heating element 46 according to the embodiment has a uniform thickness in the film thickness direction in the heater plane (e.g., the thickness of the heating element 46 being 0.03 mm). The anode side end portion 46*a* and the cathode side end portion 46*b* of the heating element 46 are electrically connected to a temperature controller (not shown) by lead wires or the like so that the temperature controller allows the current to flow to the cathode side end portion 46*b* from the anode side end portion 46*a*. The amount of heat generated by the heater 25 is controlled by regulating the amount of current from the temperature controller.

The thermistor 26, which is a temperature sensor that measures the temperature of the heater 25, is mounted on the surface of the heater 25 opposite to the mounting surface on which the head case 19 is mounted. The thermistor 26 according to the embodiment is mounted on the center portion of the heater 25 (see FIGS. 3 and 4). Specifically, the thermistor 26 has a sensor section to measure the temperature, on the surface opposing the heater 25. According to the embodiment, the sensor section is formed on the bottom surface of the thermistor 26 having a rectangular parallelepiped shape. The thermistor 26 is adhered to the bottom portion (the sensor section of the thermistor 26) facing the heater 25 by using an adhesive or the like with high heat conductivity. Lead wires or the like (not shown) are connected to the portions of the thermistor 26 other than the sensor section so that the temperature controller (not shown) reads temperature information from the thermistor 26 through the lead wires or the like. On basis of the temperature information, the temperature controller regulates the amount of heat generated by the heater 25 (heating element 46) so that the inks in the recording head 2 can be heated to a predetermined temperature by the heat generation of the heater 25.

As described above, since the heater 25 according to the embodiment is configured in such a way that the heating element 46 located in a region close to a position opposing the shared liquid flow path 29 is made narrower than a portion of the heating element 46 located at a position other than that region, it is possible to increase the amount of heat generated by the heating element 46 at the position opposing the shared liquid flow path 29, thereby positively heating the shared liquid flow path 29 which is an ink flow path in the recording head 2. As a result, the inks can be heated efficiently, thus suppressing power consumption of the heater 25. Since the heating element 46 is located at a portion of the heater 25 which does not face the shared liquid flow path 29, it is possible to prevent the ink in the flow path from discharging heat outside the recording head 2, increasing the heat retaining property. Further, it is possible to reduce regions where the heating element 46 is not disposed, increasing the rigidity of the heater 25, which makes it easier to mount the heater 25 on the recording head 2. In addition, in a case where the recording head 2 has a plurality of shared liquid flow paths 29, a plurality of heaters 25 need not be provided in association with the respective shared liquid flow paths 29, so that the recording head 2 can be manufactured easily. According to the embodiment, the heating element 46 located at both side end portions in the nozzle line direction is made narrower than the heating element 46 located in the center portion in the same direction, so that the amount of heat generated by the heating element 46 at both side end portions in the nozzle line direction can be increased to positively heat both side end portions of the recording head 2 which are likely to discharge heat. Accordingly, non-uniformness of the temperature of the ink in the recording head 2 can be suppressed.

Figure 6:
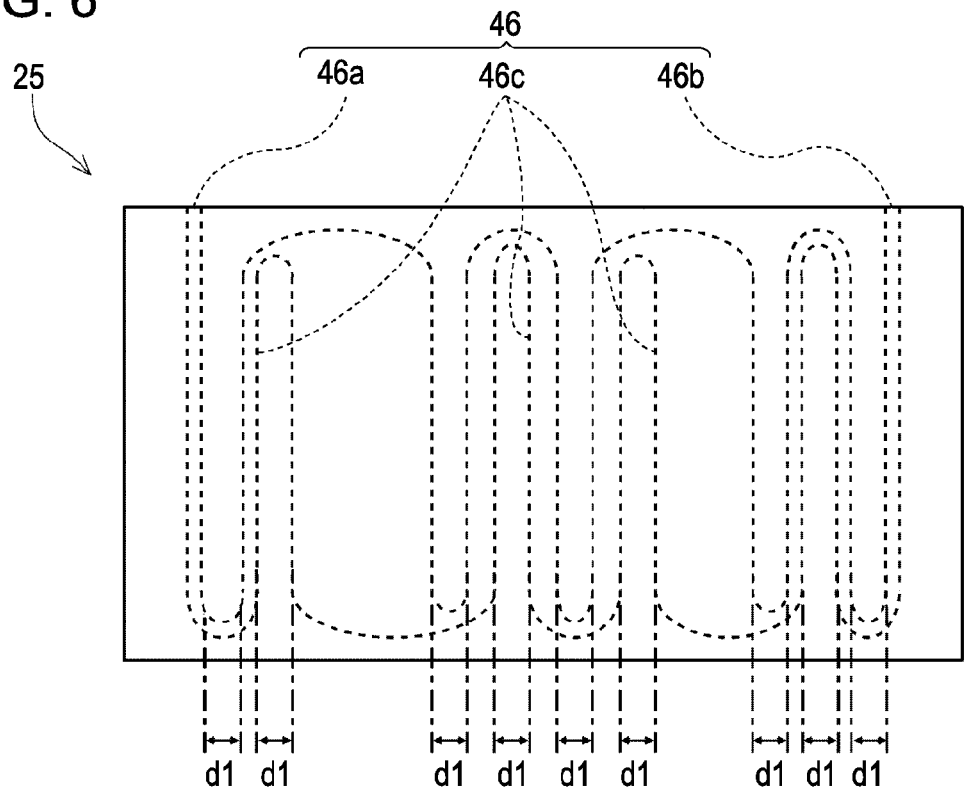
FIG. 6 is a side view of a heater according to a second embodiment.
Figure 7:
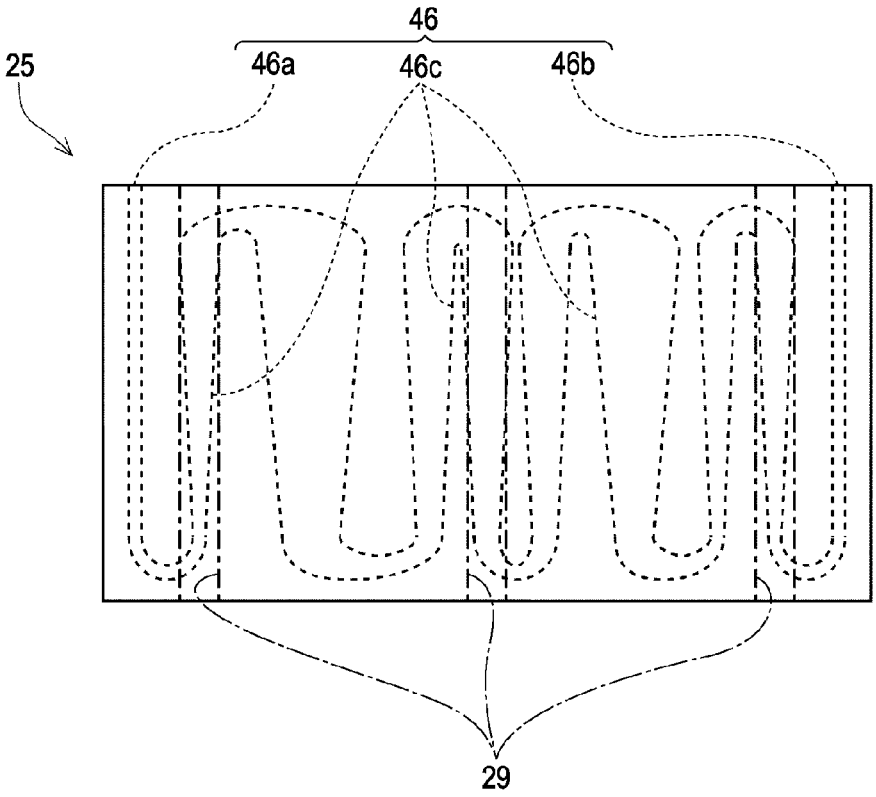
FIG. 7 is a side view of a heater according to a third embodiment.
Figure 8:
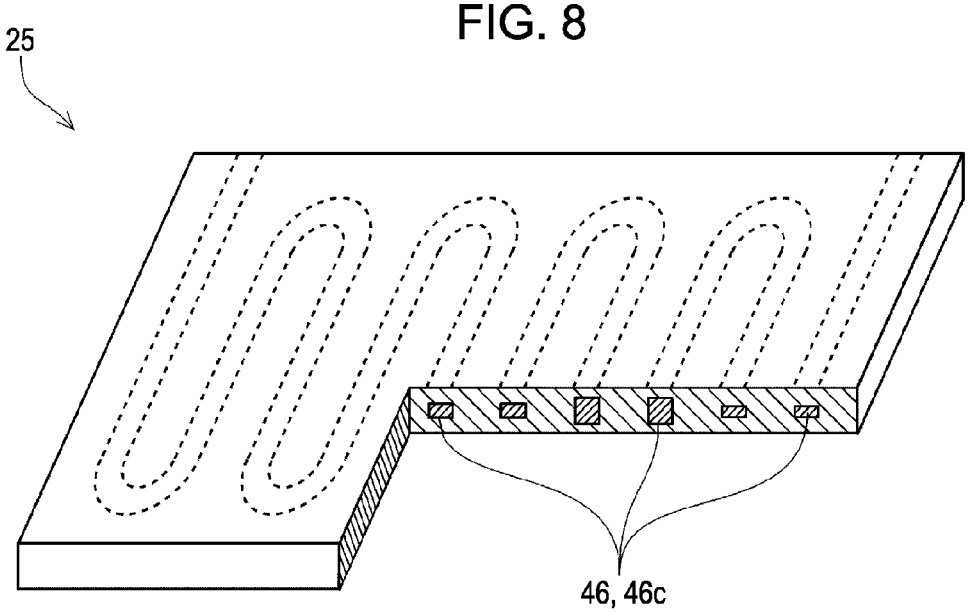
FIG. 8 is a partly cutaway perspective view of a heater according to a fourth embodiment.

The structure that varies the amount of heat generation in the heater plane is not limited to that of the first embodiment described above. For example, other embodiments are illustrated as second to fourth embodiments in FIGS. 6 to 8. In FIG. 7, the positions of the shared liquid flow paths 29 with the heaters 25 mounted on the recording head 2 are shown by alternate long and short dash lines. In FIGS. 6 and 8, though not illustrated, the shared liquid flow paths 29 are formed at positions similar to those in FIGS. 5 and 7.

The second embodiment shown in FIG. 6 differs from the first embodiment in that the intervals between adjoining folded portions of the heating element 46, i.e., the widths in the nozzle line direction of the portions between the folded portions of the heating element 46 where the heating element 46 is not formed, are set to a uniform interval. Specifically, the straight portions 46*c* of the heating element 46 disposed at both side end portions and the center portion in the heater plane are made narrower than the straight portions 46*c* disposed in the remaining region (region other than both side end portions and the center portion) in association with the shared liquid flow paths 29 as per the first embodiment. Further, the straight portions 46*c* disposed at both side end portions are made narrower than the straight portions 46*c* disposed at the center portion in the heater plane. In addition, intervals d1 between adjoining straight portions 46*c* are set uniformly (e.g., intervals of 0.5 mm). Since the other structures are the same as that of the first embodiment, their descriptions are omitted.

Since the intervals between adjoining folded portions of the heating element 46 are set uniformly, it is possible to prevent the intervals of the heating element 46 from becoming dense, making it easier to manufacture the heater 25. When the pattern of the heating element 46 is formed by wet etching, for example, if the intervals between the adjoining straight portions 46*c* are too narrow, the etchant does not easily impregnate, so that the line widths of portions of the heating element 46 may not be formed as intended. However, this is not of concern in the present embodiment. Further, a portion of the heating element 46 located in a region close to a position opposing the shared liquid flow path 29 is made narrower than a portion of the heating element 46 located at a position other than that region, making it possible to increase the amount of heat generated by the heating element 46 at the position opposing the shared liquid flow path 29 so that the shared liquid flow path 29 which is an ink flow path in the recording head 2 can be heated positively. This can allow the inks to be heated efficiently, thus suppressing the power consumption of the heater 25. Moreover, because a portion of the heating element 46 is located at a portion of the heater 25 which does not face the shared liquid flow path 29, it is possible to prevent the ink in the flow path from discharging heat outside the recording head 2, increasing the heat retaining property. Furthermore, it is possible to reduce regions where the heating element 46 is not located, increasing the rigidity of the heater 25, which makes it easier to mount the heater 25 on the recording head 2. In addition, in a case where the recording head 2 has a plurality of shared liquid flow paths 29, it is not necessary to provide a plurality of heaters 25 in association with the respective shared liquid flow paths 29, facilitating the manufacture of the recording head 2. According to the embodiment, portions of the heating element 46 located at both side end portions in the nozzle line direction are made narrower than a portion of the heating element 46 disposed in the center portion in the same direction, so that the amount of heat generated by the heating element 46 at both side end portions in the nozzle line direction can be increased to positively heat both side end portions of the recording head 2 which are likely to discharge heat. This can suppress non-uniformness of the temperature of the ink in the recording head 2.

According to the third embodiment shown in FIG. 7, the line width of the heating element 46 changes in the heater plane in a direction orthogonal to the nozzle line 27 as well as in the nozzle line direction. That is, in the direction orthogonal to the nozzle line 27, a portion of the heating element 46 located in an end portion of the heater 25 on the flow path unit 24 side is made narrower than a portion of the heating element 46 located in an end portion of the heater 25 on the side opposite the flow path unit 24 side. In detail, the straight portions 46*c* of the heating element 46 are formed in a fan shape in which the line width gradually increases from the end portion of the heater 25 on the flow path unit 24 side (lower side in FIG. 7) toward the end portion of the heater 25 opposite the flow path unit 24 side (upper side in FIG. 7). Accordingly, the line width at the end portion of the heater 25 on the flow path unit 24 side becomes minimum, and the line width at the end portion of the heater 25 opposite the flow path unit 24 side becomes maximum. The embodiment employs a structure where the line widths of the straight portions 46*c* other than the straight portions 46*c* at both side end portions of the heater 25 (straight portions 46*c* extending vertically from the anode side end portion 46*a* and the cathode side end portion 46*b*) differ in the direction orthogonal to the nozzle line 27. In addition, the straight portions 46*c* of the heating element 46 which are disposed at both side end portions of the heater 25 and the center portion of the heater 25 in the heater plane are made narrower than the straight portions 46*c* of the heater 25 disposed in the remaining regions (regions other than both side end portions of the heater 25 and the center portion of the heater 25). Further, the straight portions 46*c* of the heating element 46 disposed at both side end portions of the heater 25 in the heater plane are made narrower than the straight portions 46*c* of the heating element 46 disposed at the center portion of the heater 25 in the heater plane. Specifically, ten straight portions 46*c* are arranged side by side, and three straight portions 46*c* disposed at the center portion of the heater 25 in the nozzle line direction are formed wider than three straight portions 46*c* disposed at both side end portions of the heater 25, excluding the straight portions 46*c* which are disposed at both side end portions of the heater 25 and whose line widths are not changed (one at the left side end portion and two at the right side end portion in FIG. 7). Further, the straight portions 46*c* of the heating element 46 respectively disposed between the center portion and both side end portions of the heater 25 are formed widest, one straight portion 46*c* being disposed between the center portion of the heater 25 and the left side end portion of the heater 25 and between the center portion of the heater 25 and the right side end portion of the heater 25 (e.g., the straight portions 46*c* which are disposed at both side end portions of the heater 25 in the nozzle line direction and whose line widths are not changed have a line width of 0.3 mm, the three straight portions 46*c* disposed at the center portion of the heater 25 have a maximum line width of 0.7 mm and a minimum line width of 0.5 mm, the three straight portions 46*c* disposed at both side end portions of the heater 25, excluding the straight portions 46*c* which are disposed at both side end portions of the heater 25 and whose line widths are not changed, have a maximum line width of 0.5 mm and a minimum line width of 0.3 mm, and the straight portions 46*c* disposed between the center portion of the heater 25 and the left side end portion of the heater 25 and between the center portion of the heater 25 and the right side end portion of the heater 25 have a maximum line width of 2.0 mm and a minimum line width of 1.5 mm). Since the other structures are the same as that of the first embodiment, their descriptions are omitted.

As the heating element 46 disposed at the end portion of the heater 25 on the flow path unit 24 side in the direction orthogonal to the nozzle line 27 in the heater plane is made narrower than the heating element 46 disposed at the opposite end portion of the heater 25 to the flow path unit 24, the amount of heat generated by the heating element 46 at the end portion of the heater 25 on the flow path unit 24 side can be increased to positively heat the ink on the flow path unit 24 side which is likely to discharge heat. Accordingly, the inks can be heated efficiently. In addition, the heating element 46 disposed in a region close to a position opposing the shared liquid flow path 29 is made narrower than the heating element 46 disposed at a position other than that region, it is possible to increase the amount of heat generated by the heating element 46 at the position opposing the shared liquid flow path 29, thereby positively heating the shared liquid flow path 29 which is an ink flow path in the recording head 2. As a result, the inks can be heated efficiently, thus suppressing power consumption of the heater 25. Since the heating element 46 is disposed at a portion of the heater 25 which does not face the shared liquid flow path 29, it is possible to prevent the ink in the flow path from discharging heat outside the recording head 2, increasing the heat retaining property. Further, it is possible to reduce regions where the heating element 46 is not disposed, increasing the rigidity of the heater 25, which makes it easier to mount the heater 25 on the recording head 2. In addition, in a case where the recording head 2 has a plurality of shared liquid flow paths 29, a plurality of heaters 25 need not be provided in association with the respective shared liquid flow paths 29, facilitating the manufacture of the recording head 2. According to the embodiment, the heating element 46 disposed at both side end portions of the heater 25 in the nozzle line direction is made narrower than the heating element 46 disposed at the center portion of the heater 25 in the same direction, so that the amount of heat generated by the heating element 46 at both side end portions of the heater 25 in the nozzle line direction can be increased to positively heat both side end portions of the recording head 2 which are likely to discharge heat. Accordingly, non-uniformness of the temperature of the ink in the recording head 2 can be suppressed.

According to the foregoing individual embodiments, the amount of heat generation in the heater plane is regulated by changing the line width of the heating element 46, but the invention is not limited to this. According to the fourth embodiment shown in FIG. 8, for example, the thickness of the heating element 46 is varied in the film thickness direction of the heater 25 to regulate the amount of heat generation in the heater plane.

According to the fourth embodiment, ten straight portions 46*c* of the heating element 46 are arranged side by side, and two straight portions 46*c* disposed at the center portion in the nozzle line direction (region close to a position opposing the shared liquid flow path 29 formed in the center portion) are formed thicker than four straight portions 46*c* disposed at both side end portions (two at the left side end portion and three at the right side end portion in FIG. 7). Further, four straight portions 46*c* respectively disposed between the center portion and both side end portions are formed thickest, two straight portions 46*c* being disposed between the center portion and the left side end portion and between the center portion and the right side end portion (e.g., the two straight portions 46*c* disposed at the center portion in the nozzle line direction have a line width of 0.04 mm, the four straight portions 46*c* disposed at both side end portions have a line width of 0.03 mm, and the remaining straight portions 46*c* have a line width of 0.08 mm). The line widths of the straight portions 46*c* are made uniform, and the pitches between the straight portions 46*c* arranged side by side are also made uniform. Since the other structures are the same as that of the first embodiment, their descriptions are omitted.

As a portion of the heating element 46 disposed in a region close to a position opposing the shared liquid flow path 29 is made thinner than a portion of the heating element 46 disposed at a position other than that region, the amount of heat generated by the heating element 46 at the position opposing the shared liquid flow path 29 can be increased to positively heat the shared liquid flow path 29 which is an ink flow path in the recording head 2. As a result, the inks can be heated efficiently, thus suppressing power consumption of the heater 25. Since the heating element 46 is disposed at a portion which does not face the shared liquid flow path 29, it is possible to prevent the ink in the flow path from discharging heat outside the recording head 2, increasing the heat retaining property. Further, it is possible to reduce regions where the heating element 46 is not disposed, increasing the rigidity of the heater 25, which improves the workability in mounting the heater 25 to the recording head 2. In addition, in a case where the recording head 2 has a plurality of shared liquid flow paths 29, a plurality of heaters 25 need not be provided in association with the respective shared liquid flow paths 29, facilitating the manufacture of the recording head 2. Furthermore, the heating element 46 disposed at both side end portions in the nozzle line direction is made thinner than the heating element 46 disposed at the center portion in the same direction, so that the amount of heat generated by the heating element 46 at both side end portions in the nozzle line direction can be increased to positively heat both side end portions of the recording head 2 which are likely to discharge heat. Accordingly, non-uniformness of the temperature of the ink in the recording head 2 can be suppressed.

Moreover, the heating element in the invention is not limited to the heating elements 46 according to the first to fourth embodiments, and the heating element 46 may have all or some of the features of the individual embodiments. For example, the thickness as well as the line width of the heating element 46 may be changed, or the heating element 46 disposed at the end portion on the flow path unit 24 side in the direction orthogonal to the nozzle line 27 in the heater plane may be made thinner than the heating element 46 disposed at the opposite end portion to the flow path unit 24. Modifications may be made as long as the amount of heat generated by the heating element 46 can be increased to positively heat the shared liquid flow path 29 by changing the line width and the thickness of the heating element 46 disposed in a region close to a position opposing the shared liquid flow path 29.

According to the embodiments, piezoelectric vibrators of a so-called vertical vibration mode are exemplified as pressure generating means, but the invention is not limited to this. For example, the invention can be adapted to a case where piezoelectric vibrators and heat generating elements of a so-called flexural vibration mode are used. Further, the thermistor is exemplified according to the embodiments, but the invention is not limited to this. For example, a thermocouple temperature sensor or the like may be used.

The invention is not limited to a printer, and may be adapted to various ink jet type recording apparatuses, such as a plotter, facsimile and copying machine, and liquid ejecting apparatuses other than the recording apparatus, such as a display manufacturing apparatus, electrode manufacturing apparatus and chip manufacturing apparatus.

What is claimed is:

1. A liquid ejecting head comprising:

a flow path unit that has a nozzle line formed by a plurality of nozzles and includes a flow path communicating with the nozzles, wherein the flow path unit includes a nozzle plate and a flow path forming substrate having a first surface adjacent to the nozzle plate, the flow path forming substrate defining a pressure generating chamber on a second surface opposite to the first surface;

a head case that forms a shared liquid flow path for supplying a liquid to the flow path of the flow path unit and is connected with the flow path unit; and a sheet-like heater that is mounted on a side surface of the head case and has a continuous heat-generatable heating element folded multiple times, the heating element located in a region close to a position opposing the shared liquid flow path being narrower than the heating element disposed at a position other than the region.

2. The liquid ejecting head according to claim 1, wherein portions of the heating element located at both ends of the heater in the nozzle line direction are narrower than the heating element disposed in the center of the heater in the nozzle line direction.

3. The liquid ejecting head according to claim 1, wherein intervals between adjoining folded portions of the heating element are set to a uniform interval.

4. The liquid ejecting head according to claim 1, wherein a portion of the heating element located at an end of the heater on the flow path unit side is narrower than a portion of the heating element located at an end of the heater opposite to the flow path unit in a direction orthogonal to the nozzle line in a plane of the heater.

5. The liquid ejecting head according to claim 1, wherein the thickness of the heating element varies in a film thickness direction.

6. The liquid ejecting head according to claim 1, wherein a plurality of the shared liquid flow paths are formed along the nozzle line direction.

7. The liquid ejecting head according to claim 1, wherein a thickness of the heating element equals between 0.03 mm and 0.08 mm.

8. The liquid ejecting head according to claim 1, wherein a width of the heating element equals between 0.3 mm and 2.0 mm.

9. The liquid ejecting head according to claim 1, wherein the flow path forming substrate is made of silicon.

10. The liquid ejecting head according to claim 1, wherein a pattern of the heating element is formed by etching.

11. The liquid ejecting head according to claim 1, wherein the head case defines a cavity that is not part of the flow path, the cavity including a vibration unit.

12. The liquid ejecting head according to claim 1, wherein a heat sensor is attached directly to the surface of the sheet-like heater.

13. The liquid ejecting head according to claim 1, wherein a distance between adjoining straight portions of the heating element are uniformly distributed at intervals of 0.5 mm.

* * * * *